US011970862B2

(12) United States Patent
Babaz

(10) Patent No.: US 11,970,862 B2
(45) Date of Patent: Apr. 30, 2024

(54) RAINWATER COLLECTOR TO BE MOUNTED ON A DOWNPIPE, COMPRISING A REMOVABLE SCOOP

(71) Applicant: ALUX INTERNATIONAL TRADING S.A., Grevenmacher (LU)

(72) Inventor: Michel Babaz, Briancon (FR)

(73) Assignee: ALUX INTERNATIONAL TRADING S.A., Grevenmacher (LU)

( * ) Notice: Subject to any disclaimer, the term of this patent is extended or adjusted under 35 U.S.C. 154(b) by 348 days.

(21) Appl. No.: 17/545,234

(22) Filed: Dec. 8, 2021

(65) Prior Publication Data

US 2022/0178145 A1 Jun. 9, 2022

(30) Foreign Application Priority Data

Dec. 8, 2020 (FR) ..... 2012875

(51) Int. Cl.
*E04D 13/08* (2006.01)

(52) U.S. Cl.
CPC ..... *E04D 13/08* (2013.01); *E04D 2013/082* (2013.01)

(58) Field of Classification Search
CPC .. E03B 3/02; E03B 3/03; E04D 13/08; Y02A 20/108
USPC ... 137/561 R, 873, 875, 876, 872, 356, 357; 210/88, 153
See application file for complete search history.

(56) References Cited

U.S. PATENT DOCUMENTS

| | | | | |
|---|---|---|---|---|
| 5,490,538 | A * | 2/1996 | Marcel | E04D 13/08 137/561 A |
| 8,741,132 | B2 * | 6/2014 | Graf | E04D 13/08 52/12 |
| 9,534,358 | B2 * | 1/2017 | Griffin | E03B 3/02 |
| 9,988,817 | B2 * | 6/2018 | Johnson | E04D 13/08 |

FOREIGN PATENT DOCUMENTS

| | | |
|---|---|---|
| EP | 2400065 | 12/2011 |
| EP | 2696007 | 6/2017 |
| FR | 2688813 | 9/1993 |
| GB | 2248262 | 4/1992 |
| GB | 2528971 | 2/2016 |
| WO | 2010132682 | 11/2010 |

OTHER PUBLICATIONS

Written Opinion and Search Report issued in corresponding FR Application No. 2012875, dated Aug. 11, 2021.

* cited by examiner

*Primary Examiner* — Patrick F Brinson
(74) *Attorney, Agent, or Firm* — Burris Law, PLLC

(57) ABSTRACT

A rainwater collector to be mounted on a downpipe and including a saddle, a scoop, and a scoop support. The saddle is configured to be coupled to the downpipe. The saddle has an orifice configured to be placed opposite an opening formed in the downpipe. The scoop is configured to be introduced into the downpipe through the orifice of the saddle. The scoop support is configured to be mounted through the orifice of the saddle and to support the scoop inside the downpipe. The scoop and the scoop support are removably coupled to each other. The scoop support has a base and a bearing frame extending from the base. The scoop support further includes a tab extending from the base within the bearing frame. The tab being elastically deformable to form a clamp with the bearing frame and to hold the scoop between the tab and the bearing frame.

11 Claims, 5 Drawing Sheets

RAINWATER COLLECTOR TO BE MOUNTED ON A DOWNPIPE, COMPRISING A REMOVABLE SCOOP

CROSS-REFERENCE TO RELATED APPLICATIONS

This application claims priority to and the benefit of FR 20/12875 filed on Dec. 8, 2020. The disclosure of the above application is incorporated herein by reference.

FIELD

The present disclosure relates to the design and manufacture of equipment for the collection of rainwater.

More specifically, the present disclosure relates to a device to be mounted on a downpipe for collecting the water flowing in the downpipe and extracting it for storage in a tank.

BACKGROUND

The statements in this section merely provide background information related to the present disclosure and may not constitute prior art.

A known device is described by the patent document published under the number FR2688813, which describes a rainwater collector comprising a saddle and a scoop. The saddle is configured to partially encompass the downpipe having a sleeve configured to be placed opposite a passage made beforehand in the downpipe. The scoop is overmolded on a scoop support. The scoop support being configured to be fitted through the saddle to position the scoop inside the downpipe.

According to this technique, once placed inside the downpipe, the scoop extends over almost the entire internal conduit of the downpipe, this by forming a recess in its center which allows passage, following the intensity of the rain, about 50% of the water flowing down the downpipe. As a result, the water collection is not optimal, particularly in light rain.

Another drawback of the prior art lies in the fact that the manufacture of the device for collecting rainwater involves the use of several injection molds when the parts are manufactured by injection. More specifically a mold for the body of the collector (including the cavity for the valve); and a mold for overmolding the scoop on the body of the collector, and in particular on the scoop support (two overmolding molds being desired in practice, one to make a circular scoop and the other a rectangular scoop, can thus be adapted to two types of downpipe).

Furthermore, an operator is mobilized on each molding press to perform the overmolding of the scoop on the scoop support of the body of the collector.

This results in relatively high manufacturing costs.

Moreover, according to the existing technique, the scoop is made of rubber, and needs to be lubricated to be introduced into the downpipe passing through the orifice of the saddle. In addition, in use, it is found that the scoop loses its flexibility as it hardens over time, which can degrade the operation of the collector and necessitate its replacement.

SUMMARY

This section provides a general summary of the disclosure and is not a comprehensive disclosure of its full scope or all of its features.

The present disclosure overcomes these drawbacks of the prior art. More specifically, the present disclosure provides a rainwater collector of the type comprising a saddle configured to be coupled to a downpipe and a scoop configured to be introduced into the downpipe through an orifice in the saddle, which allows easy and inexpensive maintenance of the collector, and in particular of the scoop of the collector.

The present disclosure also provides such a rainwater collector which can be manufactured by injection at a cost lower than that of the solution of the prior art.

The present disclosure further provides such a rainwater collector which improves water collection.

These objectives, as well as others which will appear subsequently, are achieved thanks to the present disclosure which relates to a rainwater collector to be mounted on a downpipe of the type comprising a saddle configured to be coupled to the downpipe having an orifice configured to be placed opposite an opening formed in the downpipe, a scoop configured to be introduced into the downpipe through the orifice in the saddle, and a scoop support configured to be mounted through the orifice in the saddle and to support the scoop inside the downpipe. The scoop and the scoop support are separably coupled.

Thus, the maintenance of the collector, and in particular of its scoop, can be carried out easily. In fact, all you have to do is remove the scoop and the scoop support from the downpipe to quickly and easily replace the scoop without tools.

Furthermore, a user can obtain the saddle and the scoop support regardless of the shape of the downpipe then choose the scoop suitable for the downpipe and mount it on the scoop support.

Moreover, in terms of manufacture, in particular by an injection technique, the present disclosure makes it possible to dispense with the recourse for a mold for overmolding the scoop on the scoop support of the body of the collector. This also saves personnel, since an operator no longer has to be on the press performing the overmolding of the scoop.

In one form, the scoop support has a base and a bearing body extending from the base. The scoop support further comprises a tab extending from the base inside the bearing frame. The tab being elastically deformable to form a clamp with the bearing frame and hold the scoop between the tab and the bearing frame. The term "elastically deformable" means that the tab is more flexible than the rest of the scoop support and that it can be more easily deformed, without being altered, than the rest of the scoop support, in particular by remaining within its domain of elastic deformations. In this way, the scoop can be installed simply and quickly on the scoop support without the use of any tools. Removing the scoop from the scoop support can be done just as easily and quickly. In other words, with a scoop support thus formed, it suffices to slide the scoop between the support scoop and the tab to obtain the mounting and maintenance of the scoop according to the base of the scoop support. The tab acts, to form the clamp, by tightening the scoop against the frame. A simple pulling force on the scoop to remove it from the base may be enough to overcome the holding force of the tab which then authorizes the scoop to be removed.

In another form, the tab has a narrowing in width near the base. It is understood that the tab has a proximal portion and a distal portion. The proximal portion being the portion on the side or near the base while the distal portion is the portion disposed opposite the base with respect to the proximal portion. In this way, the elasticity of the tab is promoted.

In yet another form, the frame may have at least one protuberance partially filling the narrowing of the tab. Thus, the protuberance(s) of the frame exert a complementary holding force of the tab at the level of the narrowing.

In one form, the tab has at least one catch and the scoop has at least one recess in which the catch is configured to be housed. According to this form, an additional retention of the scoop on the base is obtained. To remove the scoop from the base, one must move away the tab and therefore the catch(es) of the corresponding recess(es). Such a design inhibits unexpected removal of the scoop from the scoop support.

In another form, the saddle has a baseplate configured to partially match the downpipe and to be fixed to the downpipe and a first pipe extending from the baseplate and therefore one end presents the orifice of the saddle. The base of the scoop support forming a second pipe configured to be inserted and held in the first pipe. A good retention of the scoop support relative to the saddle is thus obtained, as well as a guide of the scoop support towards the inside of the downpipe, this by the cooperation of the first and second pipes.

In yet another form, the first pipe and the base may have respective means for angular positioning of the first pipe relative to the base. This provides that the scoop is correctly oriented inside the downpipe. The base of the scoop support itself being correctly positioned angularly with respect to the first pipe of the saddle.

In one form, the scoop support has a concave seat configured to extend inside the downpipe. The scoop being configured to match the shape of the concave seat. Thus, the scoop once positioned inside the downpipe, has a concave shape, which improves its ability to collect water and evacuate it from the downpipe.

In another form, the scoop has a hanging part configured to be coupled to the scoop support, and a rainwater catching part extending from the hanging part. The catching part being made of a deformable material, preferably polypropylene. The term "deformable material" means a material more easily elastically deformable than the rest of the collector. For example, such a deformable material has a low coefficient of elasticity, and for example allows easy elastic deformation with the force of the hand. Therefore, by being made of a deformable material, the catching part of the scoop can be retracted during the introduction into the orifice of the saddle with a view to its engagement in the downpipe, and is re-deployed once introduced inside the downpipe, this by following the shape of the concave seat and therefore by itself retaining a concave shape to collect rainwater. It should be noted that this curved shape of the scoop, being retained when introduced into the downpipe, facilitates the eventual removal of the scoop from the downpipe.

In yet another form, the scoop, or at least the intake part of the scoop, made of polypropylene is not only flexible, but also proves to be very resistant over time. In addition, the scoop thus made of polypropylene does not need to be lubricated to be introduced into the saddle and into the downpipe.

In one form, the base consists of two parts of complementary shape to form a cylinder body whose end part has an outer thread configured to cooperate with an outer connection to the collector. Such a design of the base makes it possible to simplify the corresponding manufacturing mold. In addition, given the small size of the parts making up the collector, it would be possible to consider the injection of two complete sets of collector into a single mold.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
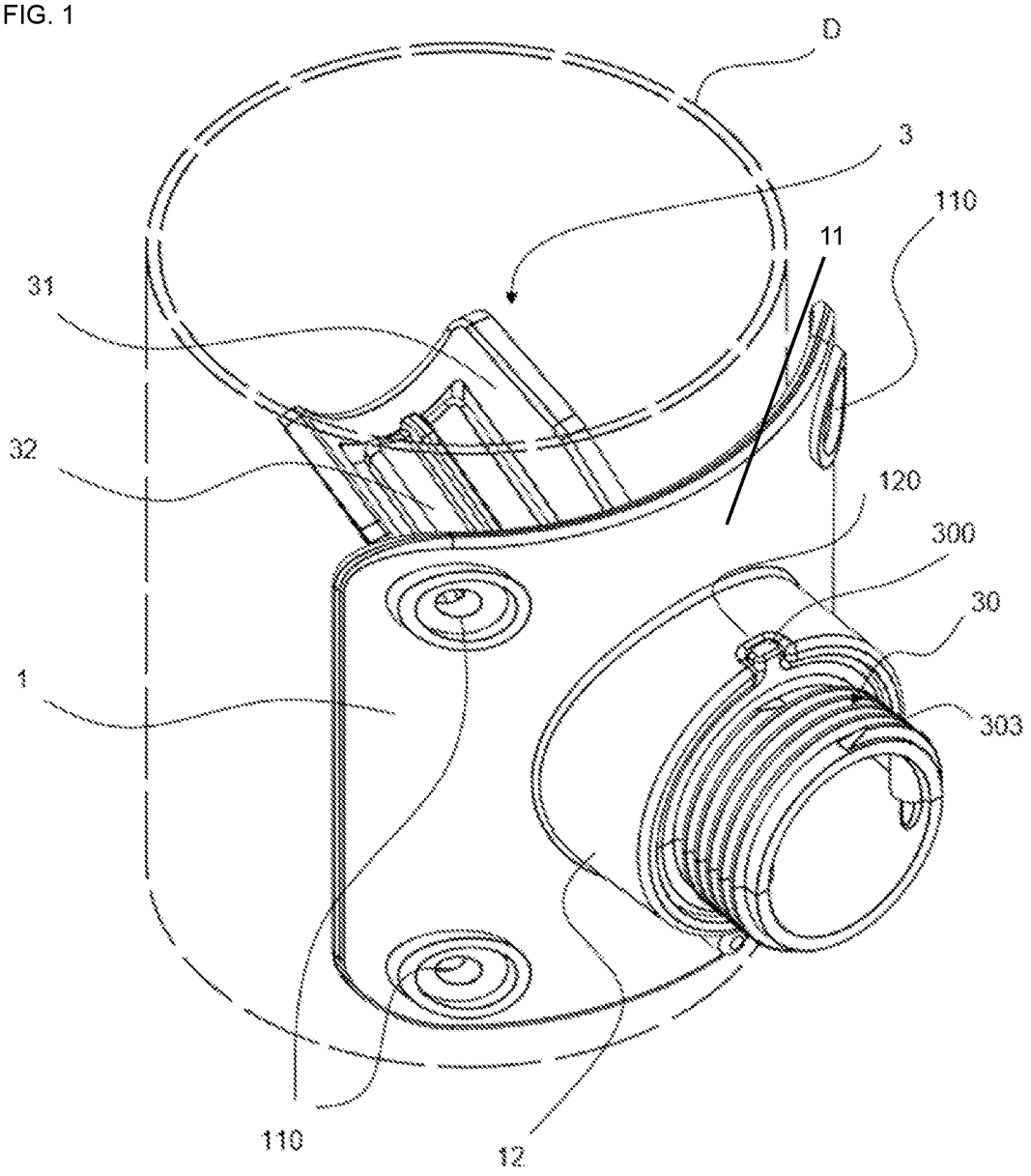
FIG. 1 is a perspective view of a rainwater collector according to the principles of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

As illustrated by FIGS. 1 to 4, a rainwater collector according to the present disclosure is of the type to be mounted on a downpipe D, and comprises a saddle 1 configured to be coupled to the downpipe D, a scoop 2 (FIG. 5) configured to be introduced into the downpipe D through the orifice 10 of the saddle 1, and a scoop support 3 configured to be mounted through the orifice 10 of the saddle 1 and supporting the scoop 2 inside the downpipe D. The saddle 1 having an orifice 10 configured to be placed opposite an opening O formed in the downpipe D (for example using a hole saw).

Figure 2:
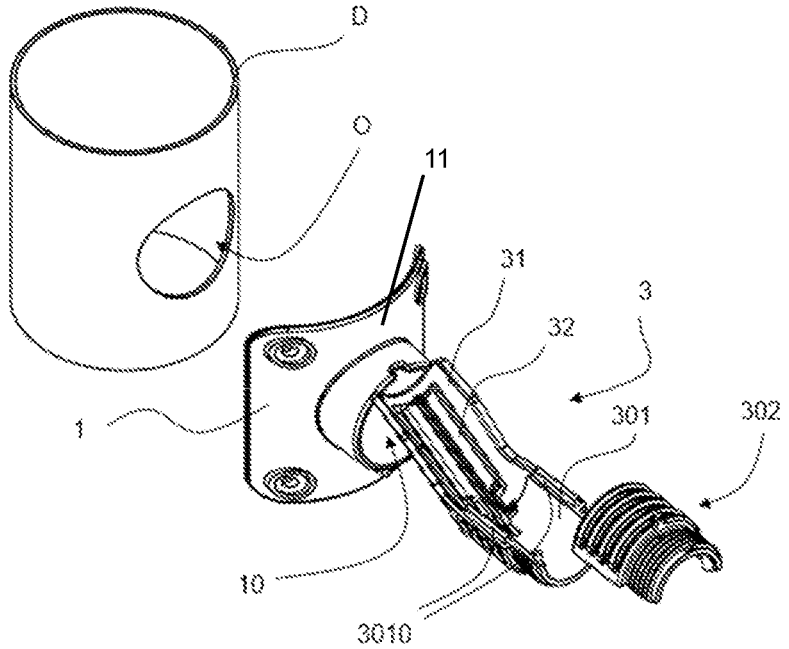
FIG. 2 is an exploded view of the rainwater collector of FIG. 1.

As shown in FIGS. 1 and 2, the saddle 1 has a shape complementary to the downpipe D, with a view to partially match the outer contour of the downpipe.

Figure 5:
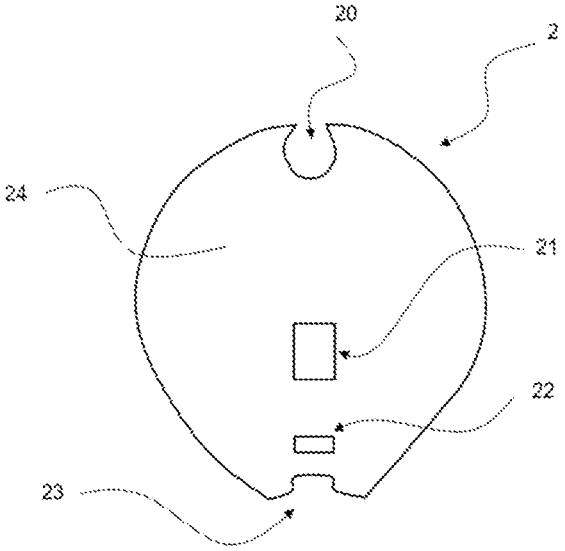
FIG. 5 is a top view of a scoop of the rainwater collector of FIG. 1.
Figure 7:
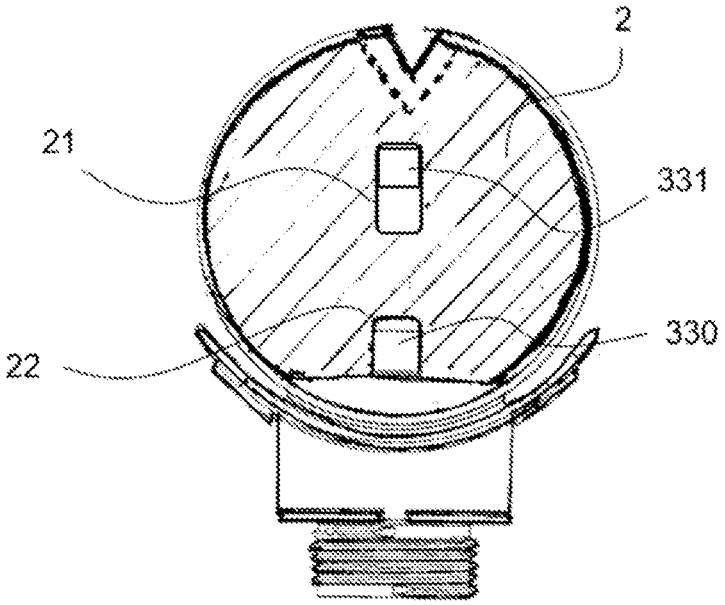
FIG. 7 is a top view of a scoop mounted on the scoop support of FIG. 6.

As shown in FIG. 5, the scoop 2 has a curved contour configured to match the internal contour of the downpipe. In particular, the scoop 2 has a notch 20 allowing, once the scoop 2 in the downpipe D, to bring the two ends of the notch 20 closer together to make the scoop 2 take a cup shape whose contour is adjusted to the internal contour of the downpipe D. It is noted that such a notch 20 can take other shapes, for example a V shape (as shown in FIG. 7).

It is noted that such a notch 20 also performs an "overflow" function, in the sense that it allows some of the water to pass through, which can be useful in heavy rain.

As illustrated, the downpipe D has a circular section, and the saddle 1 has a curved base or baseplate 11 to partially match the downpipe.

In certain situations, the downpipe D has a square or rectangular section, and the saddle 1 has a base accordingly adapted (for example flat) to be fixed to one of the sides of the downpipe.

In addition, the base 11 of the saddle has fixing orifices 110, in this case four orifices, namely one orifice 110 at each corner of the base 11. The attachment of the saddle 1 to the downpipe D can thus be obtained using self-drilling screws engaged through the orifices 110 and screwed into the material of the downpipe D.

According to the principle of the present disclosure, the scoop 2 and the scoop support 3 are separably coupled. That is, the scoop support 3 has a base 30 and a bearing frame 31 extending from the base 30. In addition, the scoop support comprises a tab 32 extending from the base 30, inside the bearing frame 31. The tab 32 is elastically deformable to form a clamp with the bearing frame 31 and keep the scoop 2 between the tab 32 and the bearing frame 31.

In particular, the tab 32 is flexible in an area near the base 30 so as to be able to be moved away from the bearing frame 31 when inserting the scoop 2 on the scoop support 3, or to remove it. By being elastically deformable, once released from its position away from the bearing frame 31, the tab 32 returns to its initial position, registering approximately within the frame of the support or in close proximity to it. At the very least, in the close position of the tab 32 relative to the bearing frame 31, the distance between the tab 32 and the bearing frame 31 is less than the thickness of the scoop 2.

To promote bending of the tab 32, in particular in the vicinity of the base 30 of the scoop support 3, the tab 32 has a narrowing in width near the base.

Figure 3:
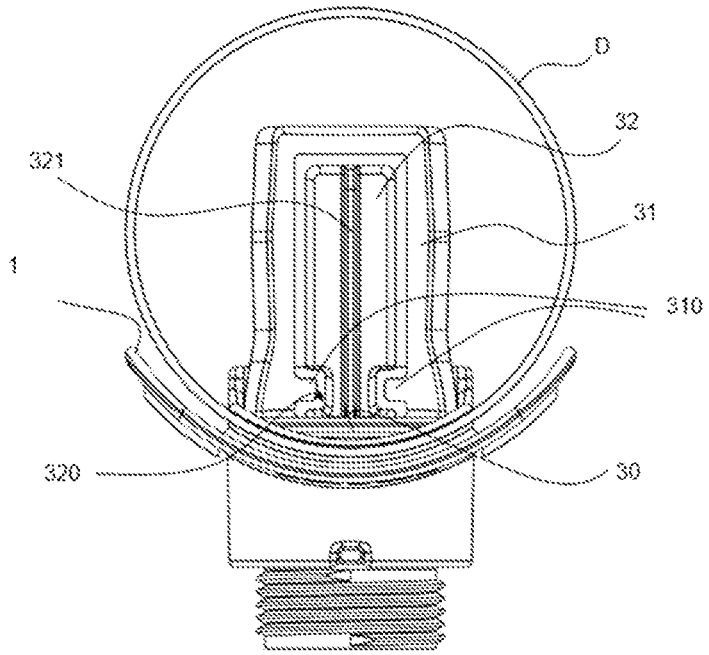
FIG. 3 is a top view of the rainwater collector of FIG. 1.

As shown in FIG. 3, the narrowing is obtained by two lateral recesses 320 on either side of a central part of the tab 32 extending from the base 30 of the support scoop 3. In this configuration, the frame 31 has for its part two protuberances 310 each coming to fill one of the recesses 320 and thus partially fill the narrowing of the tab 32.

Furthermore, the tab 32 has, on its upper wall, a central longitudinal bead 321, having a tensor function aimed at applying a force for holding the tab 32 on the scoop 2 against the bearing frame 31.

Figure 4:
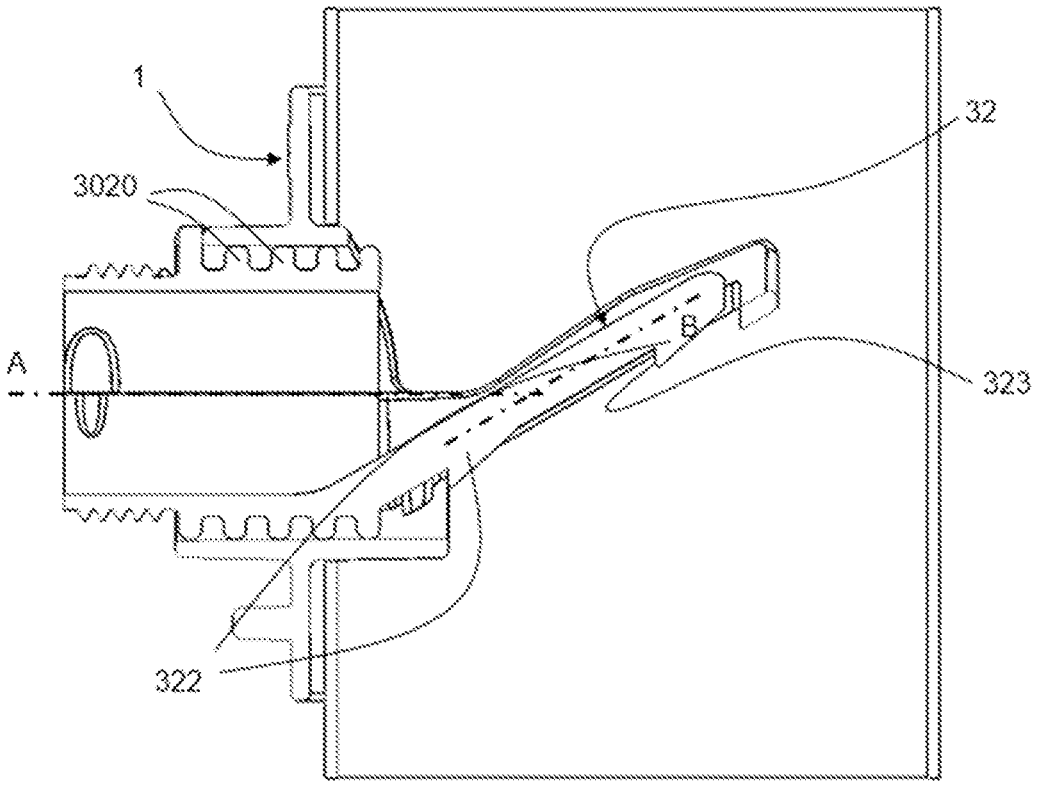
FIG. 4 is a cross-sectional view of the rainwater collector of FIG. 1.

Referring to FIG. 4, the tab 32 has, on its underside, at least one catch and in this case two catches 322. As shown in FIG. 5, the scoop has a recess 21, 22 for each catch 322, these recesses 21 being configured to accommodate a catch 322 of the tab 32. Thus, once the scoop 2 is installed on the scoop support 3 with the recesses 21 correctly placed to accommodate the catches 322, the shoulder 323 of each catch 322 forms a stop for an edge of the corresponding recess 21 of the scoop 2, thus opposing withdrawal of the scoop 2 from the tab 32. In other words, it is desired to pull on the tab 32 in order to bend it and move it away from the bearing frame 31 so as to release the catches 322 of the tab 32 from the recesses 21 of the scoop 2 in order to be able to separate the scoop 2 from the scoop support 3.

Moreover, as shown in the exploded view provided by FIG. 2, the scoop support 3 is obtained by plastic injection of two parts 301, 302 of complementary shapes. Once assembled, the parts 301 and 302 form a cylindrical body whose outer surface has an outer thread 303, making it possible to connect the base of the scoop support 3 to an outer connection to the collector, to direct the water towards a storage tank for example.

The part 301 has, on each of its diametrically opposed edges, a lug 3010. The part 302 has for its part, on each of its diametrically opposed edges, a recess of complementary shape to the lugs 3010, the assembly of the parts 301 and 302 being obtained by snapping the lugs 3010 into the corresponding recesses of the part 302. As a result, the scoop support 3 breaks down into two parts, namely the cylindrical body formed by the assembly of parts 301 and 302 is configured to be housed in a pipe of the saddle as will be explained below and the support itself extending from the base formed by the assembly of parts 301 and 302, consisting of the bearing frame 31 and the tab 32.

As shown in FIG. 4, the cylindrical body of the base extends about a central axis A. The tab 32 and the bearing frame 31 extend in turn in a direction B which has an inclination with respect to the central axis A. Preferably, this inclination is in the range of 25°, which makes it possible, for the rainwater collected by the scoop 2 to accelerate its evacuation out of the downpipe D.

As illustrated by FIGS. 1 and 2, the scoop support 3 has, from the base, a concave seat configured to extend inside the downpipe. This is materialized by the curved shape of the bearing frame 31 and the tab 32. The scoop 2 is configured to match the shape of the concave seat when forced by the tab 32 against the bearing frame 31.

To do this, the scoop 2 is preferably made of a deformable material such as flexible polypropylene. Such a feature therefore makes it possible to curve the scoop 2 inside the downpipe D giving it a cup shape which promotes water collecting on the one hand and which, on the other hand, facilitates its removal from the downpipe D if needed.

Thus, advantageously, the scoop 2 is made in the form of a flexible polypropylene sheet and has, as illustrated in FIG. 5, a hanging part 23 configured to be coupled to the scoop support 3, and a part 24 for intaking rainwater extending from the hanging part 23. At least the intake part is made of polypropylene.

With reference to FIGS. 1 to 4, the saddle 1 has the baseplate 11 configured to partially match the downpipe D and to be fixed to the downpipe D as mentioned above and a first pipe 12 extending from the baseplate 11 and whose one end presents the orifice 10 of the saddle.

Once the parts 301 and 302 of the scoop support 3 are brought together, the base of the scoop support 3 is formed and forms a second pipe configured to be inserted and maintained in the first pipe 12 of the saddle 1.

It is noted that the cylindrical body formed by the assembly of the parts 301 and 302 has, over part of its length, a series of annular beads 3020 (FIG. 4) whose outside diameter is equal, except for the clearance, to the inner diameter of the first pipe 12 of the saddle. These beads 3020 are dimensioned so as to impose a mounting of the second pipe in the first pipe 12 in a slightly forceful manner.

In addition, as shown in FIG. 1, the first pipe 12 and the base 30 have respective means 120, 300 for angular positioning. These respective angular positioning means consist of a notch 120 formed at the free end of the first pipe 12 of the saddle 1 and a lug 300 formed on the outer surface of the second pipe formed by the cylindrical body of the scoop support 3. The lug 300 being configured to be housed in the notch 120 and, therefore, angularly position the scoop support 3 relative to the first pipe 12 of the saddle 1.

As a result, the scoop 2 carried by the scoop support 3 is itself oriented angularly inside the downpipe D.

It should be noted that the rainwater collector according to the present disclosure can be manufactured by an injection molding technique. Thus, the saddle 1 and the scoop support (itself formed by parts 301 and 302) are molded in the same mold.

Figure 6:
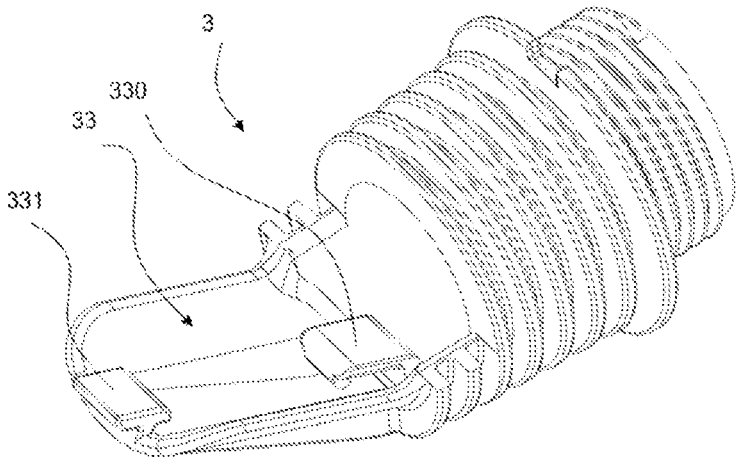
FIG. 6 is a perspective view of a scoop support according to a second form.

According to another form, the scoop support 3 can take the form illustrated in FIG. 6. As shown in this figure, the scoop support 3 has, in common with the first form, a base from which extends a cradle 33 having transversely a curved section configured to impose a curved shape as well with the flexible scoop once it is mounted on the cradle 33.

Figure 8:
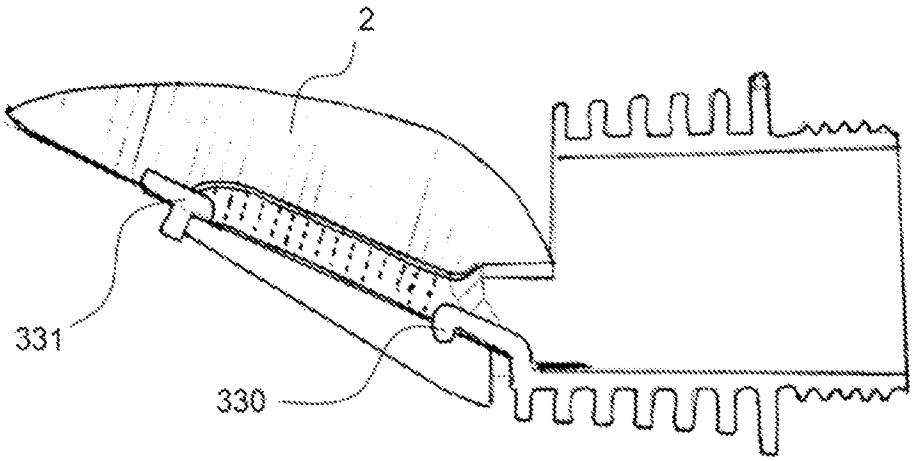
FIG. 8 is a cross-sectional view of the scoop of FIG. 7 mounted on the scoop support of FIG. 6.

Referring to FIGS. 6 to 8, the scoop 2 has according to this form, a first notch 21 in its hanging part and a second notch 22.

The scoop 2 is configured to be inserted under the first hook 330 of the cradle 33, located near the base and then to be raised in its hanging part so that the hook comes to be housed in the first notch 21. Then, the scoop 2 is clipped onto the cradle 33 by introducing the second hook 331 of the cradle 33, present at the free end of the cradle (or in the vicinity thereof), into the second notch 22. Thus, when the water flows over the scoop, the water exerts a constraint due to its weight which tends to keep the scoop 2 coupled to the cradle 33. It is understood that the cradle 33 has a proximal portion and a distal portion. The proximal portion being the portion on the side or near the base while the distal portion is the portion disposed opposite to the base relative to the proximal portion; and presenting the free end (or distal end).

According to one or the other of the forms which have just been described, the scoop, made from a flexible sheet of polypropylene, can be manufactured in several models. The collector can then be supplied with several of the scoop models, selected by the user following the advice indicated on an installation manual according to the surface of his roof (in particular so that the water does not rise up roof during heavy downpours) and/or the shape and dimensions of the downpipe with which the collector is configured to be associated.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A rainwater collector to be mounted on a downpipe, the rainwater collector comprising:

a saddle configured to be coupled to the downpipe, the saddle having an orifice configured to be placed opposite an opening formed in the downpipe;

a scoop configured to be introduced into the downpipe through the orifice of the saddle; and a scoop support configured to be mounted through the orifice of the saddle and to support the scoop inside the downpipe, wherein the scoop and the scoop support are removably coupled to each other, wherein the scoop support has a base and a bearing frame extending from the base, the scoop support further comprising a tab extending from the base within the bearing frame, the tab being elastically deformable to form a clamp with the bearing frame and to hold the scoop between the tab and the bearing frame.

2. The rainwater collector according to claim 1, wherein the tab of the scoop support has a narrowing in width near the base.

3. The rainwater collector according to claim 2, wherein the bearing frame has at least one protuberance partially filling the narrowing of the tab.

4. The rainwater collector according to claim 1, wherein the tab of the scoop support has at least one catch and the scoop has at least one recess in which the catch is configured to be housed.

5. The rainwater collector according to claim 1, wherein the saddle comprises:

a baseplate configured to partially match the downpipe and to be fixed to the downpipe; and a first pipe extending from the baseplate and having an end comprising the orifice of the saddle, wherein the base of the scoop support forms a second pipe configured to be inserted and held in the first pipe.

6. The rainwater collector according to claim 5, wherein the first pipe and the base have respective means for angular positioning.

7. The rainwater collector according to claim 1, wherein the scoop support has a concave seat configured to extend inside the downpipe, the scoop being configured to match the shape of the concave seat.

8. The rainwater collector according to claim 1, wherein the scoop has a hanging part configured to be coupled to the scoop support and an intake part for intaking rainwater extending from the hanging part, the intake part being made of a deformable material.

9. The rainwater collector according to claim 8, wherein the deformable material is polypropylene.

10. The rainwater collector according to claim 1, wherein the base comprises two parts of complementary shapes to form a cylindrical body, the cylindrical body comprising an end part having an outer thread configured to cooperate with an outer connection to the collector.

11. A rainwater collector to be mounted on a downpipe, the rainwater collector comprising:

a saddle configured to be coupled to the downpipe, the saddle having an orifice configured to be placed opposite an opening formed in the downpipe;

a scoop configured to be introduced into the downpipe through the orifice of the saddle; and a scoop support configured to be mounted through the orifice of the saddle and to support the scoop inside the downpipe, wherein the scoop support has a base and a cradle extending from the base, the cradle comprising a first hook near the base and a second hook at a free end of the cradle, the scoop comprising a first notch and a second notch, the scoop being configured to be inserted under the first hook so that the first hook is housed in the first notch and to be clipped onto the cradle by inserting the second hook into the second notch.

* * * * *